United States Patent [19]

Scott

[11] 4,016,893

[45] Apr. 12, 1977

[54] SOLVENT PUMPING SYSTEM

[76] Inventor: Donald C. Scott, 761 W. La Deney, Ontario, Calif. 91762

[22] Filed: Oct. 22, 1975

[21] Appl. No.: 624,704

Related U.S. Application Data

[63] Continuation-in-part of Ser. No. 531,054, Dec. 9, 1974, abandoned.

[52] U.S. Cl. ..... 134/115 R; 134/191; 417/406; 137/565

[51] Int. Cl.[2] ..... F04B 17/00; B08B 3/00

[58] Field of Search ..... 417/405, 406, 407, 409; 137/565; 134/198, 115 R, 191

[56] References Cited

UNITED STATES PATENTS

| | | | |
|---|---|---|---|
| 1,434,800 | 11/1922 | Tucker | 417/406 |
| 1,664,488 | 4/1928 | Schellens | 417/407 |
| 2,020,956 | 11/1935 | Norling | 417/406 |
| 3,352,310 | 11/1967 | Boyscher | 134/198 X |
| 3,759,290 | 9/1973 | D'Alba | 417/406 X |
| 3,794,448 | 2/1974 | Albertson | 417/406 |

*Primary Examiner*—William R. Cline

*Attorney, Agent, or Firm*—Christie, Parker & Hale

[57] ABSTRACT

This liquid recirculation system is particularly suitable for flammable solvents since the liquid is pumped by an air powered pump. The system has a solvent tank with a sink mounted on top of it for drainage into the tank. A centrifugal liquid pump is immersed below the liquid level in the tank for pumping liquid to a spout over the sink. A centrifugal air turbine is mounted above the liquid level for driving the pump. The liquid pump and air turbine have identical housings at opposite ends of a tubular housing. A drive shaft mounted in bushings or bearings at the ends of the tubular housing connects impellers in the turbine and pump. Each impeller is a flat disk with a plurality of flat upstanding blades with a substantially larger number of blades on the turbine impeller than on the pump impeller. Air enters the turbine tangentially and is discharged through an outlet on the top of the turbine. Liquid enters the pump through an opening on the bottom of the pump and is discharged through a tangential outlet extending in the same sense of rotation as the air inlet on the turbine.

19 Claims, 10 Drawing Figures

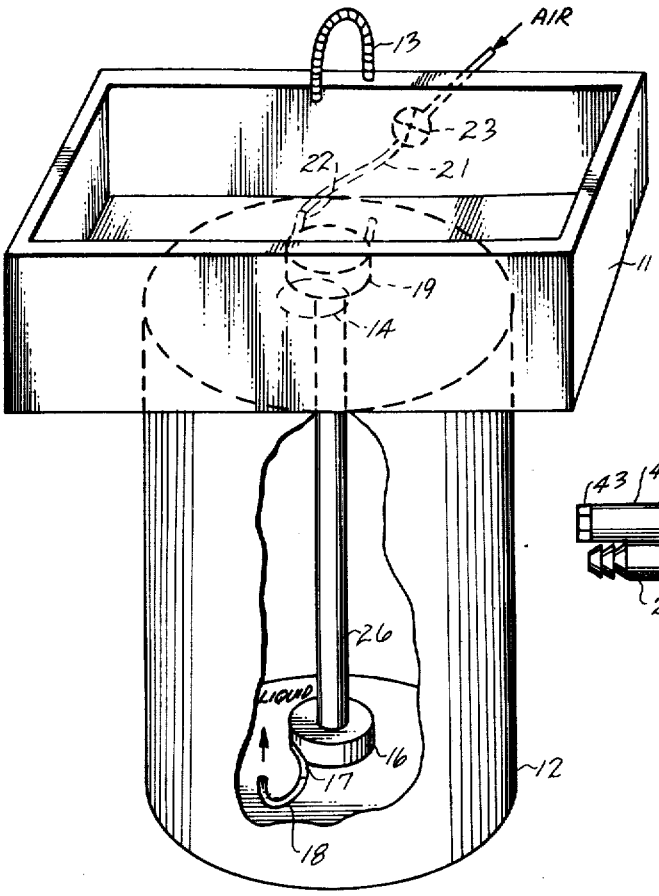
Fig. 1
Fig. 5
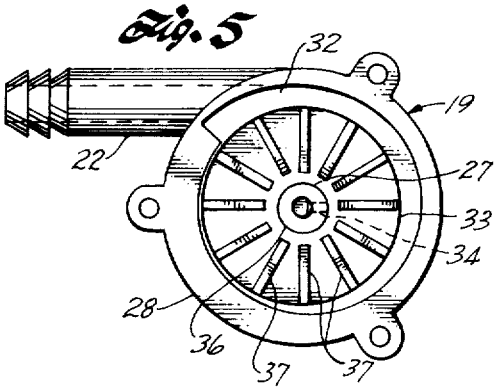
Fig. 2
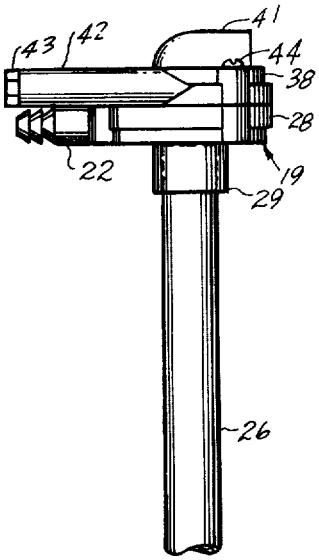
Fig. 4
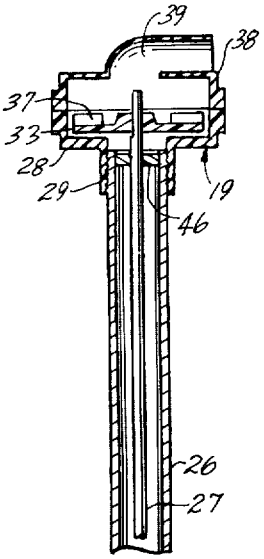
Fig. 3
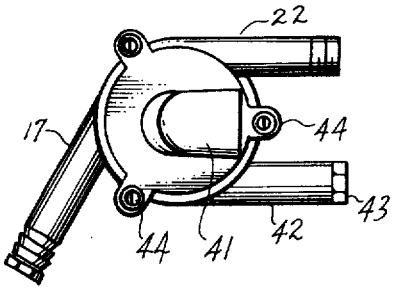
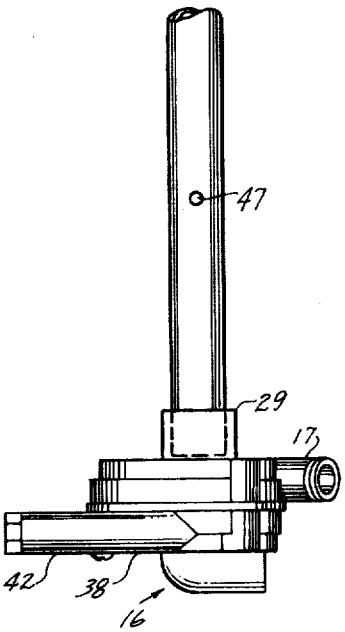
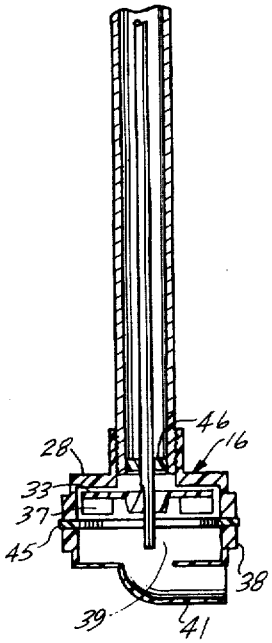

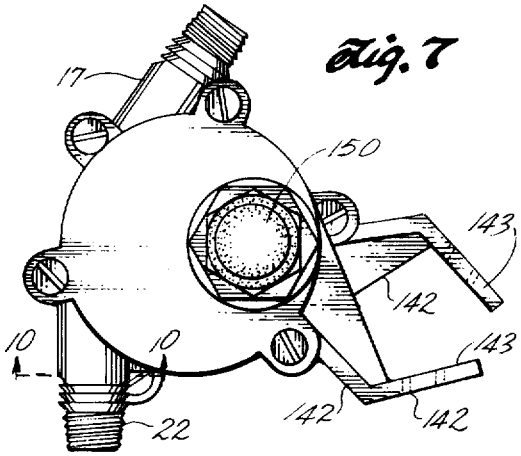
Fig. 7
17
150
143
142
10
10
143
22
142
142
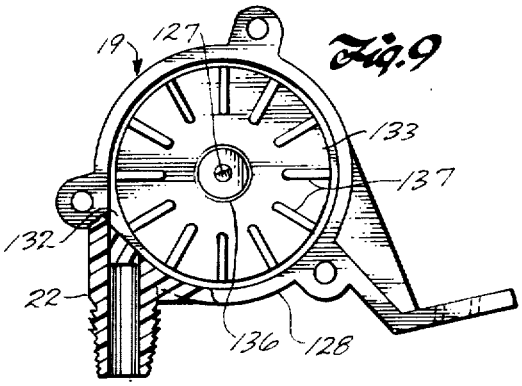
Fig. 9
19
127
133
137
132
22
136
128
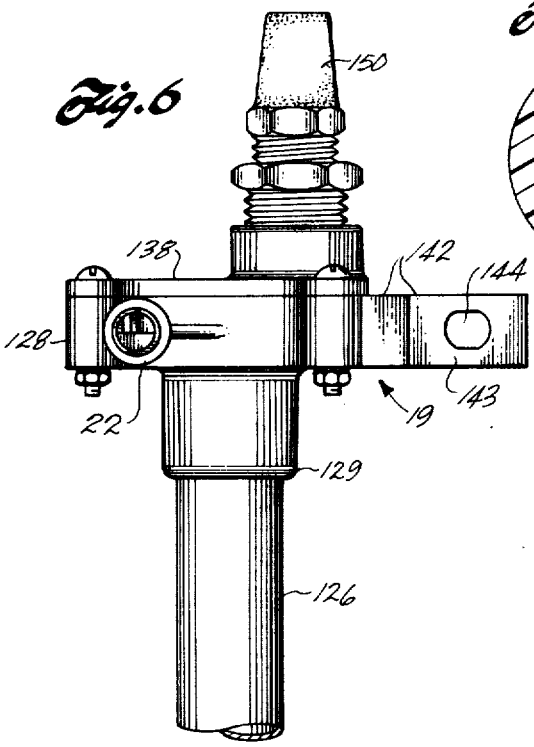
Fig. 6
150
138
142
144
128
22
143
19
129
126
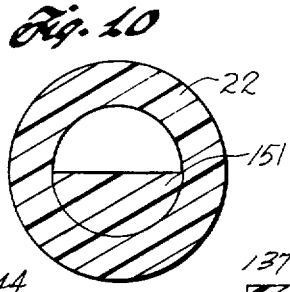
Fig. 10
22
151
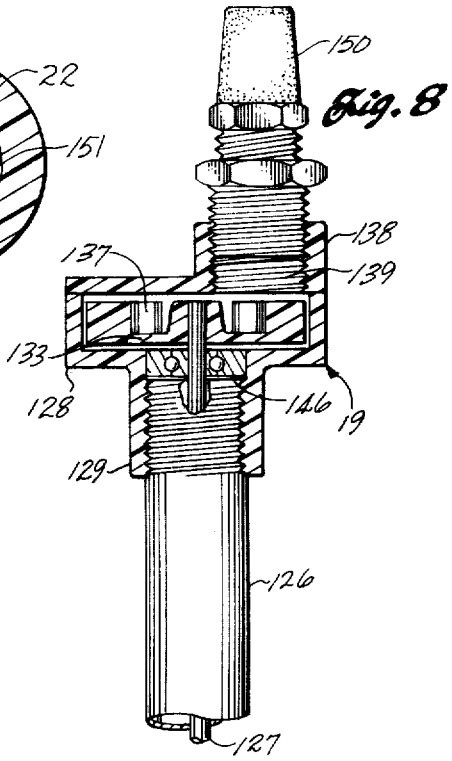
150
Fig. 8
138
137
139
133
128
146
19
129
126
127
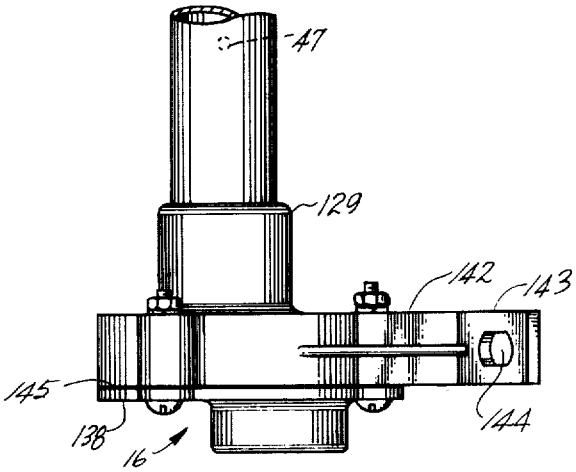
47
129
142
143
145
138
16
144
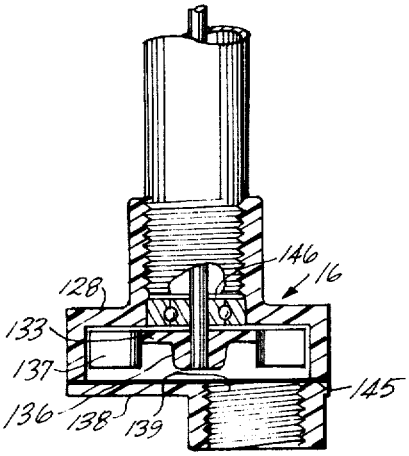
146
16
128
133
137
145
136
138
139

SOLVENT PUMPING SYSTEM

CROSS-REFERENCE TO RELATED APPLICATION

This application is a continuation-in-part of application Ser. No. 531,054 filed Dec. 9, 1974 and now abandoned.

BACKGROUND

In an automotive repair work it is quite common to clean parts by use of an organic solvent that cuts the grease and oil that usually causes dirt to adhere to the parts. The solvent can be reused for long periods and a variety of parts washing arrangements have been devised. Some of these systems have a solvent tank with a sink on top in which the parts can be washed. Solvent from the tank is circulated to a spout over the sink and drains back into the tank.

Prior solvent circulation systems have included an immersible electric pump in the solvent tank for pumping the liquid to the cleaning spout. The usual solvent used in automotive cleaning has a flash point of 140° F and the hazards of electrical equipment in that situation is readily apparent. Further, provision of immersible electric motors with electrical connections and fluid seals resistant to the solvent are expensive.

It is therefore desirable to provide a solvent recirculation system that is inexpensive and not subject to the hazards of electrical equipment.

BRIEF SUMMARY OF THE INVENTION

There is, therefore, provided in practice of this invention according to a first embodiment and a presently preferred embodiment, a solvent recirculation system having a sink mounted on top of a solvent tank. A centrifugal liquid pump in the tank below liquid level has an inlet on the bottom of the pump and a tangential outlet. A centrifugal air turbine is mounted in the tank above the normal liquid level with a tangential air inlet having the same rotational sense as the liquid outlet and an air outlet on the top of the turbine. A fixed tubular housing interconnects the pump and turbine. There is a drive shaft in the housing interconnecting an air impeller in the air turbine and a liquid impeller in the liquid pump. The drive shaft is mounted in bearings or plastic bushings at each end of the tubular housing. In a preferred embodiment, the pump and turbine are substantially identical for economy of manufacture. Additionally, the inner housing for the pump and also for the turbine carry mounting flanges. A cap with an opening radially offset from the axis of the drive shaft is attached to each housing.

DRAWINGS

These and other features and advantages of the present invention will be appreciated as the same becomes better understood by reference to the following detailed description of a first embodiment and a presently preferred embodiment when considered in connection with the accompanying drawings wherein:

FIG. 1 illustrates in cut-away perspective of a solvent circulation system constructed according to principles of this invention;

FIG. 2 is a side view of a turbine pump for the recirculation system;

FIG. 3 is an end view of the turbine pump;

FIG. 4 is a longitudinal cross section of the turbine pump;

FIG. 5 is an end view of the turbine with the outer housing removed;

FIG. 6 is a side view of the presently preferred embodiment of a turbine pump for the recirculation system;

FIG. 7 is an end view of the turbine pump of FIG. 6;

FIG. 8 is a longitudinal cross section of the turbine pump of FIG. 6;

FIG. 9 is an end view of the turbine with the end plate removed; and

FIG. 10 is an enlarged cross sectional end view of the inlet tube along line 10—10 of FIG. 7.

DESCRIPTION

In the solvent recirculation system illustrated in FIG. 1 there is a conventional metal sink 11 mounted on top of a solvent tank 12. It is convenient to employ a conventional 30 gallon steel drum for the solvent tank although larger or smaller vessels can be used in many situations. A 30 gallon drum is particularly suitable since it provides a sink at a convenient working height and contains a sufficient volume of solvent that it can be used for a long period of time without replacement. Solvent from the tank 12 is pumped up to a conventional flexible spout 13 on the back of the sink and discharges into the sink for cleaning parts contained therein. A drain 14 permits solvent to flow back into the drum 12.

A portion of the solvent tank 12 is cut away in FIG. 1 to illustrate schematically a turbine pump mounted in the tank. This same turbine pump is illustrated in side and end views respectively in FIGS. 2 and 3 in longitudinal cross section in FIG. 4. The turbine pump has a liquid pump 16 spaced above the bottom of the tank and well below the normal liquid level in the tank. It is spaced above the bottom so that dirt and other sediment in the tank are not ingested into the pump during operation. The liquid outlet 17 of the pump is connected to a tube 18, only a fragment of which is shown, which conveys the liquid to the flexible spout 13.

An air turbine 19 is provided at the top above the normal liquid level of the solvent in the tank. A shop air line 21 is connected to an air inlet 22 of the turbine, an air valve 23 which can be either manually or foot operated is connected in the air line 21. Typically, a conventional pressure regulator (not shown) is also connected in the air line for regulating air pressure, which, as pointed out hereinafter, controls the flow of liquid.

As illustrated in greater detail in FIGS. 2 to 4, the turbine pump has an elongated tubular housing 26 between the air turbine 19 and the liquid pump 16. In a typical embodiment the tubular housing can be galvanized steel pipe threaded at each end or if preferred it can be polyvinyl chloride tubing or the like. By separating the pump and turbine by a simple tubular housing, the pump and turbine can be any arbitrary distance apart for adaptability to vessels larger or smaller than a typical 30 gallon drum. Such accommodation to varying sizes is easily accomplished by varying the length of the tubular housing 26 and the drive shaft 27 in the housing extending between the turbine and pump.

Preferably the hollow, generally circular housings for the turbine 19 and pump 16 are substantially identical so that the cost of tooling is kept at a minimum. These parts are preferably made of injection molded plastic that is resistant to solvent action. The turbine and pump each have a hollow inner housing half 28 including a threaded boss 29 that screws onto the tubular housing 26. If a plastic tube is used for the tubular housing, the bosses may be smooth on the inside for cementing to the housing is a conventional manner. A tangentially extending tube is provided on each inner housing half 28. This tube serves as the air inlet 22 when the housing half is a part of the air turbine and serves as the liquid outlet 27 when the housing half is part of the liquid pump. Flared buttresses 31 on the tube provide a tight connection for flexible plastic tubing which is preferably used for conveying air or solvent. If desired the tangential tube may be internally or externally threaded to accommodate other types of tubing connectors.

As best seen in FIG. 5, which is an end view of the air turbine, the interior of the housing is generally in the form of a spiral providing a relatively wide spacing 32 adjacent the entrance of the tube into the housing. An impeller in the form of a flat circular plate 33 is mounted on the end of the drive shaft 27 by a set screw 34 through a boss 36 on the impeller. A plurality of blades 37 extend normal to the flat plate 33 on one face. In a typical embodiment these flat impeller blades are about one-quarter inch tall in the axial direction, extend about one-half inch in the radial direction, and are about 0.1 inch thick. A dozen such blades are provided on the impeller for the air turbine. The impeller for the liquid pump is similar except that only three or four such blades are provided. The number of blades on the liquid impeller is preferably an integral fraction of the number of blades on the air impeller so that the same injection molding dies can be used for both. This places the blades on the liquid impeller in positions corresponding to positions of selected blades on the air impeller. The clearance between the periphery of the impeller and the smallest radial extent of the spiral inside of the housing half is kept as low as a few thousandths of an inch.

Each of the housings at opposite ends of the tubular housing 26 also has an outer housing half 38. This outer housing half has a generally hollow interior with an axial opening 39 covered by a shroud 41 extending towards one side. When the outer housing half is a portion of the air turbine, this shroud serves as the air outlet, directing discharged air towards one side. When the outer housing half is used as a portion of the liquid pump, liquid is drawn in through the shroud from one side, thereby minimizing swirling that might occur in the liquid if the axial opening were not covered. This minimizes pickup of sediment from the bottom of the solvent tank.

Each outer housing half is also provided with a tangentially extending stud 42 that, for convenience of manufacture, is hollow. The end of the stud is internally threaded so that it receives a bolt 43 for fastening to the side of the tank 12 (FIG. 1). This serves as a mounting for the turbine pump in the tank. Each outer housing half is secured to its respective inner housing half 28 by three conventional self-tapping screws 44. By using three screws the air inlet 22 and stud 42 on the air turbine can be kept parallel to each other so that the air line is brought through the wall of the tank near the mounting stud. Since the air turbine is above the usual solvent level no special seal is needed for the air line. The inner and outer housing halves at the liquid pump are aligned 120° from this position so that the liquid outlet 17 extends into the interior of the tank while the stud connects to the tank wall. A gasket 45 is provided between the housing halves in the liquid pump.

In the present embodiment, as best seen in FIG. 4, the drive shaft 27 is mounted in polytetrafluoroethylene bushings 46 press fitted into each end of the tubular housing 26. The shaft is a snug fit in the bushings and no specific axial support is required. When the turbine pump is running, the impellers at the respective ends apparently assume an equilibrium position with respect to the housing and run without contact. The bushings may, if desired, be mounted in the respective inner housing halves or if preferred made integral therewith. Since both ends of the tubular housing are substantially closed, one or more vents 47 are provided to prevent pressure problems.

When the pump is operated air from the air line 21 passes through the air inlet 22 and impinges on the blades 37 of the turbine impeller, quickly spinning the turbine to high rotational speeds. The air then bleeds laterally out of the turbine housing through the shroud 41. Rotation of the turbine impeller causes simultaneous rotation of the pump impeller by way of the drive shaft 27 connecting them. The rapid rotation discharges liquid through the liquid outlet 17 and this liquid is replced by withdrawing from the tank through the shroud 41. The shroud over the liquid inlet inhibits formation of vortexes in the solvent that would stir up sediment from the bottom of the tank. The liquid passes through the tube 18 and is discharged into the sink through the flexible spout 13 where it can be used by an operator for washing various parts or products such as found in automotive or airplane shops, machine shops, print shops, and the like.

It will be noted that the fluid conduits or tubes for the inner housing halves extend in the same rotational sense so that as the impeller in the air turbine is driven in one direction (for example, clockwise), the impeller in the liquid pump is driven in the same direction and discharges liquid through the outlet. The mounting studs 42 on the outer housing halves extend in a rotational sense that is opposite to the rotational sense of the fluid conduit on the adjacent inner housing half. This permits the mounting studs to be connected to the tank wall without interference with the air inlet.

It will also be noted that when the outer housing half is inverted from its position as connected to the inner housing half, it is generally similar in configuration. This has a distinct advantage in minimizing the cost of tooling since the differences between the inner and outer halves are rather few. The inner housing half has a boss 29 for connection to the tubular housing and the outer housing half has a shroud 41. The injection molding dies can be made in such a manner that suitable inserts for either such connection can be readily made. In the illustrated embodiment the other difference lies in the tip of the mounting stud or conduit which can also be accommodated by suitable inserts in the molding die, or if desired, these two members can be identical. Thus, the symmetry of the housing halves provides fluid conduits and mounting studs at both ends with only minor variations in the injection molding tooling. This leads to appreciable manufacturing economies.

In a typical embodiment, the flexible spout 13 has a 5/16 inch inside diameter. With a shop air pressure of only 5 psi, 2 gallons of solvent is pumped in 1 minute, 5 seconds. At 10 psi the same quantity of solvent is pumped in slightly less than a minute. At 15 psi the turbine pump delivers 2 gallons in less than 50 seconds. When the air pressure is increased to 20 psi, solvent is delivered at a rate of about 3.4 gallons per minute.

Thus, with only nominal air pressure is sufficient volume of solvent is delivered into the sink for thoroughly cleansing parts. This is done with complete safety since air is used for providing the motive power rather than electricity and fire hazard is thereby significantly reduced.

A more efficient turbine pump is illustrated in FIGS. 6–10. This turbine pump is similar to the turbine pump of FIGS. 2–5 with an elongated housing 126 extending between two generally circular housings 128. The housings 128 are connected to the housing 126 by a threaded boss 129 that screws onto the tubular housing 126.

The interior of the housing 128 is similar to the interior of the housing 28, with an identical impeller in the form of a flat circular plate 133 mounted on the end of a drive shaft 127 by a suitable means such as a force fit and flaring or by crimping of the end of the shaft. Each end of the shaft 127 has a D-shaped portion to prevent slippage between the impeller and shaft. A plurality of blades 137 extend normal to the flat face 133 on one face to complete the impeller. As best seen in FIG. 9, which is an end view of the turbine with the cap 138 removed, the interior of the housing 128 is generally circular so that there is a substantially uniform distance between the periphery of the impeller and the inner surface of the housing throughout the circumference of the housing. At the entrance to the turbine and correspondingly at the exit of the pump there is an enlarged area 132 adjacent the tubes 22 and 17 respectively.

The drive shaft 127 is journalled in ball bearings 146 that are molded into the boss 129 of the housing 128. Each of the housings 128 has a tangentially extending tube. This tube serves as the air inlet 22 when the housing is a part of the air turbine and serves as the liquid outlet 17 when the housing is a part of the liquid pump. The tubes may be connected in the same manner as the tubes of the turbine pump of FIGS. 2 through 5.

As best seen in FIG. 10, which is an enlarged cross-sectional view along line 10—10 of FIG. 7, the interior of each tube has a restriction 151 at the end adjoining the housing so that only half of the tube is open into the housing 128. The top of the restriction 151 is positioned in the plane of the top of the plate 133 so that the air is directed against the blades above the surface of the circular plate 133. There is a similar cooperation between the surface of the circular plate 133 and the restriction 151 in the liquid outlet 17 of the pump.

A tangentially extending mounting arm 142 is provided on each housing 128. This arm can be molded with the housing 128 and can thus be an integral part thereof. Each mounting arm 142 has a flat external extension 143 with a hole 144 therein for mounting the turbine pump in the tank 12 (FIG. 1) in cooperation with a bolt and nut (not shown). The turbine pump may be attached to the tank at only one end or at both ends.

Each of the housings 128 is closed with a flat, generally circular end cap 138. This end cap 138 has an opening 139 offset from the center for improved efficiency of the pump. The opening 139 is located over the blades 137 to provide freer flow of the fluid into the pump than would be possible with the opening axially positioned over the boss 136 of the impeller.

Each end cap 138 is secured to its respective housing 128 by three bolts and nuts. A gasket 145 is provided in the pump end of the turbine pump between the housing 128 and end cap 138. A muffler 150 is attached to the opening 139 of the air turbine to reduce the noise during operation.

The turbine pump operates the same as the turbine pump of FIGS. 2 through 5. However, because of the difference in location of the fluid inlet opening 139 in the pump, the use of ball bearings, and the design of the housings and end caps, the turbine pump requires less air to pump the same amount of fluid. For example, with an inside dimension of 5/16 inch for the spout 13, two gallons of solvent are pumped in less than one minute with 5 psi of air pressure. Nearly 6 gallons of solvent are pumped in a minute at 15 psi. Additionally, this turbine pump is quieter while operating at a higher RPM for the same air pressure than the turbine pump of FIGS. 2 through 5.

Although two embodiments of the solvent pumping system having an air turbine powered liquid pump have been described and illustrated herein, many modifications and variations will be apparent to one skilled in the art. Thus, for example, the turbine impellers can be mounted on a somewhat longer drive shaft so as to be primarily in the outer housing half instead of the inner housing half. In such an embodiment, the hollow mounting studs of the present embodiment may be used for the air and liquid conduits and the corresponding tubes of the inner housing halves may be used for mounting the turbine pump in a tank. Many other modifications and variations will be apparent to one skilled in the art and it is therefore to be understood that within th scope of the appended claims, the invention may be practiced otherwise than as specifically described.

What is claimed is:

1. A solvent recirculation system comprising:

a solvent tank;

a sink mounted on top of the solvent tank including a drain for draining solvent from the sink back to the tank;

a centrifugal liquid pump mounted in the tank below the normal solvent level, and having an inlet spaced above the bottom of the tank, a cover with an opening therein for the inlet, and a tangential liquid outlet;

a centrifugal air turbine mounted in the tank above the normal solvent level, and having a tangential air inlet with the same rotational sense as the liquid outlet and an opening for the air outlet;

an air impeller in the air turbine;

a liquid impeller in the liquid pump;

a fixed tubular housing having a cross-sectional area that is smaller than the area covered by each impeller in a plane perpendicular to the axis of rotation and interconnecting the liquid pump and air turbine;

a drive shaft in the tubular housing interconnecting the air impeller and the liquid impeller;

means for mounting the drive shaft in the tubular housing for rotation; and a liquid spout over the sink connected to the liquid outlet of the pump.

2. A solvent recirculation system as defined in claim 1 wherein the air turbine and liquid pump each have a housing connected to a respective end of the tubular housing and a cover connected to the respective housing, and wherein the respective housings of the liquid pump and air impeller are substantially identical.

3. A solvent recirculation system as defined in claim 2 wherein each housing and cover includes a tangentially extending mounting arm for mounting the turbine pump on the wall of the tank and a tangentially extending fluid conduit for receiving or discharging fluid, the mounting arm and fluid conduit extending in opposite rotational sense.

4. A solvent recirculation system as defined in claim 1 wherein each opening is axially aligned.

5. A solvent recirculation system as defined in claim 1 wherein each opening is offset from the axis of the drive shaft.

6. A solvent recirculation system as defined in claim 1 wherein the liquid pump further includes a shroud over the inlet opening having a lateral opening.

7. A turbine pump comprising:

an elongated fixed tubular housing;

a hollow air housing having a generally circular cross section, fixed on the upper end of the tubular housing;

a hollow liquid housing having a generally circular cross section, fixed on the lower end of the tubular housing;

a drive shaft extending through the tubular housing from inside the air housing to inside the liquid housing;

a bearing at each end of the tubular housing, each bearing having an axial hole closely fitting on the drive shaft for mounting the drive shaft for rotation;

an air impeller in the air housing fixed to the upper end of the drive shaft, the air impeller covering an area in a plane perpendicular to the axis of rotation that is larger than the cross-sectional area of the tubular housing;

a tangential air inlet on the air housing for impinging air on the air impeller;

an air outlet on the top of the air housing;

a liquid impeller in the liquid housing fixed on the lower end of the drive shaft, the liquid impeller covering an area in a plane perpendicular to the axis of rotation that is larger than the cross-sectional area of the tubular housing;

a liquid inlet on the bottom of the liquid housing; and a tangential liquid outlet on the liquid housing aligned with the liquid impeller for discharging liquid therefrom and extending from the liquid housing in the same rotational sense as the air inlet enters the air housing.

8. A turbine pump as defined in claim 7 wherein the air housing and the liquid housing are substantially identical and each comprises:

a housing including an axial boss connected to the tubular housing;

an end cap;

means for connecting the housing and end cap together in any of a plurality of positions around the turbine pump axis; and a mounting arm on the housing for mounting the turbine pump.

9. A turbine pump as defined in claim 8 wherein each bearing is a ball bearing molded into the boss on the housing.

10. A turbine pump as defined in claim 7 wherein the air housing and the liquid housing are substantially identical and each comprises:

an inner housing half including an axial boss connected to the tubular housing;

an outer housing half;

means for connecting the inner and outer housing halves together in any of a plurality of positions around the turbine pump axis; and a mounting stud on one of the housing halves for mounting the turbine pump.

11. A turbine pump as defined in claim 7 wherein each impeller comprises a flat circular plate, a plurality of generally radially extending blades normal to the plate, and means for securing the impeller to the drive shaft.

12. A turbine pump as defined in claim 11 wherein the air impeller has a relatively larger number of blades and the liquid impeller has a relatively smaller number of blades substantially identical to the blades on the air impeller and in locations corresponding to locations of selected ones of the blades on the air impeller.

13. A turbine pump as defined in claim 11 wherein the air inlet is circular in cross section, the flat plate of the air impeller bisects the air inlet and a restriction in the air inlet closes one-half of the inlet so that the inlet is open only on the blade side of the impeller plate.

14. A turbine pump as defined in claim 11 wherein the liquid outlet is circular in cross section, the flat plate of the liquid impeller bisects the liquid outlet and a restriction in the liquid outlet closes one-half of the outlet so that the outlet is open only on the blade side of the impeller plate.

15. A turbine pump as defined in claim 11 wherein the opening into each housing for the air inlet and the liquid outlet is only on the side of the plate having the blades thereon.

16. A turbine pump as defined in claim 7 wherein each bearing is a plastic bushing press fitted into the respective end of the tubular housing.

17. A turbine pump as defined in claim 7 further comprising:

a tangentially extending mounting arm on the air turbine extending in the opposite rotational sense from the air inlet; and a tangentially extending mounting arm on the liquid pump extending in the opposite rotational sense from the liquid outlet.

18. A turbine pump as defined in claim 7 wherein the interior of the housing around each respective impeller has a circular shape with an enlarged area between the housing interior and the impeller adjacent the respective fluid inlet or outlet and relatively uniform narrow clearance between the housing interior and the impeller away from the inlet or outlet.

19. A turbine pump as defined in claim 7 wherein the interior of the housing around each respective impeller has a spiral shape with a relatively wide clearance between the housing interior and the impeller adjacent the respective fluid inlet or outlet and a relatively narrow clearance between the housing interior and the impeller spaced apart from the respective fluid inlet or outlet.

* * * * *